United States Patent [19]

Kenmochi et al.

[11] Patent Number: 5,003,804

[45] Date of Patent: Apr. 2, 1991

[54] METHOD FOR PRE-PROCESSING STAINLESS STEEL STRIP INTENDED TO BE COLD-ROLLED

[75] Inventors: Kazuhito Kenmochi; Ikuo Yarita; Akihiko Fukuhara; Tomio Komatu; Akira Kishida, all of Chiba, Japan

[73] Assignee: Kawasaki Steel Corporation, Hyogo, Japan

[21] Appl. No.: 452,967

[22] Filed: Dec. 19, 1989

[30] Foreign Application Priority Data

Dec. 23, 1988 [JP] Japan ..... 63-323705

[51] Int. Cl.[5] ..... B21B 45/04; B21B 27/10

[52] U.S. Cl. ..... 72/39; 72/41

[58] Field of Search ..... 72/39, 40, 41, 44, 45, 72/700

[56] References Cited

FOREIGN PATENT DOCUMENTS

| | | | |
|---|---|---|---|
| 51-109267 | 9/1976 | Japan | 72/39 |
| 52-17515 | 5/1977 | Japan | 72/45 |
| 54-49958 | 4/1979 | Japan | 72/45 |
| 57-22803 | 2/1982 | Japan | 72/39 |
| 57-68217 | 4/1982 | Japan | 72/39 |
| 59-118202 | 7/1984 | Japan | 72/39 |
| 59-200774 | 11/1984 | Japan | 72/39 |
| 62-34605 | 2/1987 | Japan | 72/40 |

*Primary Examiner*—E. Michael Combs

*Attorney, Agent, or Firm*—Austin R. Miller

[57] ABSTRACT

A method of pre-processing a stainless steel strip to be cold-processed comprising the steps of: annealing and pickling the stainless steel strip after completing hot rolling; applying liquid lubricant with a thickness of 1 μm or less to the surfaces of rolls before the rolls come into contact with the stainless steel strip; and rolling the stainless steel strip at a reduction ratio exceeding 5%. An apparatus for pre-processing a stainless steel to be cold-rolled comprising: annealing and picking means having a mechanical descaling device and a pickling device; rolling means consisting of rolls arranged in two or more stages; and means capable of applying liquid lubricant in a thin layer to a work roll of the rolling means.

4 Claims, 2 Drawing Sheets

METHOD FOR PRE-PROCESSING STAINLESS STEEL STRIP INTENDED TO BE COLD-ROLLED

BACKGROUND OF THE INVENTION

1. Field of The Invention

The present invention relates to a method and an apparatus for pre-processing stainless steel intended to be cold-rolled, and capable of advantageously manufacturing cold-rolled stainless steel strip exhibiting an excellent surface luster.

More specifically, the present invention relates to an improvement in a method of pre-processing a hot coil made of stainless steel prior to cold rolling, and, more particularly, to an improvement in the A.P. (Annealing and Pickling) line 2. Description of the Background Art Cold rolled stainless steel strip has been manufactured by pickling hot rolled-stainless steel strip after annealing; cold rolling the hot-rolled stainless steel strip with the surface which has been pickled remaining as it is; annealing and pickling the cold-rolled stainless steel or bright-annealing the same; and temper rolling at a reduction ratio of 1.2% or less.

Since ferritic stainless steel strips represented by JIS SUS430 are usually used without additional processing after temper rolling, a satisfactory surface luster is required. On the other hand, austenitic stainless steel strips represented by JIS SUS304 are usually subjected to buffing after temper rolling in order to obtain an excellent surface luster Therefore, processing to keep the surface roughness low is necessary for both ferritic and austenitic stainless steel strips when the temper rolling has been completed. In the case where the cold rolling is conducted by using a small diameter work roll such as a Sendzimir mill, a method in which the roughness of the work roll is reduced has been disclosed in for example, Japanese Patent Publication No. 57-13362. However with such a method, the luster of the surface of the final product is insufficient since excessive roughness, which is observed on the surface of the steel strip after hot rolling remains even after completion of cold rolling.

On the other hand, a tandem mill rolling method using a large diameter work roll having a diameter larger than 150 mmϕ has been employed, with which cold-rolled stainless steel strips can be efficiently manufactured by considerably shortening the rolling time. Also according to this method, similarly to the above-described method in which the Sendzimir mill is used, excessive roughness remains on the surface of the hot rolled steel strip after annealing, even after cold rolling. What is worse, the degree of roughness becomes excessive in comparison to the degree of roughness caused by rolling with the Sendzimir mill. Therefore, the products thus manufactured cannot be used when luster of surface is required.

In order to overcome the problems referred to above, a method has been disclosed in which the diameters of the work rolls are combined so as to realize the desired effect. This has been disclosed in, for example, Japanese Patent Laid-Open No. 61-49701. Also according to this method, as in Japanese Patent Publication No. 57-13362, excessive roughness remains on the surface of steel strip which has been annealed and pickled after hot rolling and after cold rolling.

SUMMARY OF THE INVENTION

An object of the present invention is to provide a method for manufacturing cold-rolled stainless steel strip exhibiting excellent luster on the surface thereof. More specifically, there is provided a pre-processing method capable of efficiently removing excessive roughness from the surface of the steel strip, the excessive roughness being generated when the hot-rolled steel strip is annealed and pickled.

A second object of the present invention is to provide a method for pre-processing a material by using a cold tandem mill for the purpose of producing a stainless steel strip exhibiting excellent luster on the surface thereof.

A further object of the present invention is to provide an apparatus with which the above-described pre processing can be efficiently conducted.

Further objects of the present invention will be apparent when reading the specification of the present invention According to the present invention, there is provided a method of pre-processing stainless steel strip to be cold-processed comprising the steps of: annealing and pickling the stainless steel strip after completing hot rolling; applying a thin-film liquid lubricant so as to ensure a thickness of said lubricant of 1 μm or less at the surfaces of rolls immediately prior to their contact with the stainless steel strip; and rolling the stainless steel strip at a reduction ratio exceeding 5%.

Furthermore, there is provided an apparatus for pre-processing stainless steel to be cold-rolled comprising: annealing and pickling means having a mechanical descaling device and a pickling device; rolling means consisting of rolls arranged in two or more stages; and means capable of applying a thin layer of liquid lubricant to a work roll of the rolling means.

PREFERRED EMBODIMENTS OF THE INVENTION

An embodiment of the present invention will be described with reference to the drawings.

Figure 1:
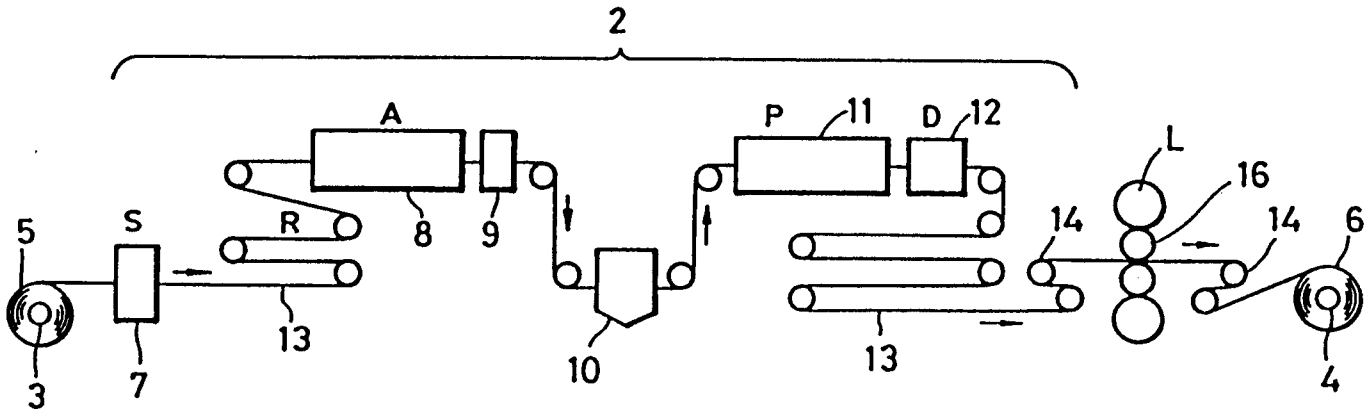
FIG. 1 is a schematic view which illustrates an embodiment of an apparatus according to the present invention.

Referring at first briefly to FIG. 1, the apparatus shown comprises an annealing pickling device 2 for hot-rolled stainless strip and a rolling mill 1 capable of cold-rolling the strip at a reduction ratio exceeding 5%. The annealing and pickling of the hot-rolled steel strip are conducted by the annealing-pickling device 2. That is, the steel strip rewound from a pay-off reel 3 is annealed in a continuous annealing furnace 8, and the scales on the surface are removed by a mechanical descaling device 10 before the strip is pickled in a pickling tank 11. According to the present invention, the steel strip which has been pickled in the pickling tank 11 is rolled by rolls 16 of the low-pressure rolling device 1 on which is deposited a thin layer of liquid lubricant of a thickness of 1 μm or less and the rolling is applied at a reduction ratio exceeding 5%, this rolling being conducted prior to the usual cold rolling As a result, the degree of roughness of the surface of the steel strip caused by pickling can be reduced prior to the regular cold rolling operation. Therefore, steel strip exhibiting reduced surface roughness and excellent surface luster can be obtained.

It has now been found that the surface roughness of steel strip which has been cold-rolled is influenced by a partial residue of surface roughness of the precursor steel strip which has not been cold-rolled. Expressed otherwise, the steel strip which has been annealed and pickled after hot rolling has a partial residue a portion of which remains even after cold rolling.

The causes of this are as follows: The surface roughness of the hot rolled steel strip shows an excessive average roughness Ra value of 2 to 4 μm immediately after annealing and pickling, due to a mechanical descaling processing such as a shot blast or due to acid pickling. When a steel strip which has been thus annealed and pickled is subsequently cold-rolled, a large quantity of rolling oil is usually supplied to the surfaces of the rolls before the rolls come into contact with the material. Thus, lubrication and cooling of the surface of the steel strip and the surfaces of the rolls are simultaneously conducted so that galling flaws such as heat streaks are prevented. As a result, the rolling of the steel strips can be conducted stably.

However, the large quantity of rolling oil having a thickness of more than several μms adheres to the surface of the steel strip on the supply side of the cold rolling rolls, the adhered rolling oil then occupying and remaining in excessively large pits formed on the surface of the steel strip caused by annealing and pickling conducted after hot rolling. The steel strip, with the rolling oil remaining in its pits, is then rolled, and rolling is conducted with the oil in the pits and retained during the time in which the rolls and the steel strip are positioned in contact with each other.

In general, liquid, such as rolling oil, is extremely difficult to compress in comparison to a gas such as air. Therefore, the pits in which the rolling oil is enclosed are inevitably retained even after the rolling process has been completed. As a result, according to the conventional method, the surface roughness of the steel strip before cold rolling remains as it was even after cold rolling. Therefore, the surface luster of the product is harmed considerably.

Therefore, it has been discovered that steel strip exhibiting excellent surface luster can be obtained by smoothing the surface of steel strip before it has been cold-rolled.

We have discovered that it is necessary for the steel strip to be subjected to substantially oil free rolling in which there is no use of any liquid such as rolling oil. The substantially non lubricated rolling is conducted prior to cold rolling. However, completely oil-free rolling causes the friction coefficient to be raised excessively and galling occurs between the rolls and the steel strip As a result, the load required for rolling becomes too large, and desired rolling cannot be conducted.

Therefore, the inventors of the present invention discovered the present invention after study of a method of pre-processing stainless steel strips with which the following two necessary factors can be simultaneously satisfied.

(1) It has been found necessary that the rolls and the steel strip are protected from galling at the time of the pre-processing rolling operation.

(2) The rough portions on the surface of the steel strip after annealing and pickling can be reduced by pre-processing to a size which is sufficient for subsequent cold rolling.

That is, the rough portions on the surface of the steel strip which has been annealed and pickled after hot rolling can be satisfactorily reduced, since galling can be prevented by lubrication with an oil of reduced thickness. We have found that the above-described rough portions on the surface of the steel strip can be sufficiently reduced by making the film thickness 1 μm or less, preferably, 0.5 μm or less. If the film thickness exceeds 1 μm, excessive rough portions remain which cannot be removed by subsequent cold rolling.

It is preferable that materials possessing galling preventing performance, and capable of reducing the rough portions on the surface, be used when thin film lubrication is conducted. These materials are such as water, skin-pass oil, rolling oil, rolling oil emulsion or the like. It is further preferable that a liquid lubricant having a viscosity of 1 to 15 centi-stokes be used. It is necessary to conduct the pre-processing rolling at a reduction ratio exceeding 5%.

That is, it has been factually confirmed from experiments that the surface luster cannot be substantially improved when the pre-processing rolling is conducted at a reduction ratio of 5% or less in any kind of rolling using small work rolls such as those in a Sendzimir mill or the like, or by rolling using large work rolls such as a cold tandem mill or the like, or by their combination. Furthermore, it has been confirmed that the surface luster can be significantly improved if the rolling reduction ratio exceeds 5%.

If the rolling reduction ratio exceeds 20%, seizure takes place between the rolls and the material to be rolled. Therefore, it is preferable that the rolling reduction ratio be 20% or less.

The operation of a processing apparatus according to the present invention will now be described, with reference to the drawings, together with a modification.

A hot-rolled stainless steel strip 5 (FIG. 1) is set to a pay-off reel 3, and a head end portion of the stainless steel strip 5 is sheared by a shear 7 and joined to the tail end of a stainless steel strip which has already passed through the pay-off reel 3, this connection being established by using a welding machine 7. Then, the thus connected hot-rolled steel strip 5 is passed through an inlet-side looper 13 before being annealed by a continuous annealing furnace 8. The thus annealed steel strip is cooled down in a cooling zone 9. A portion of the oxidized scale on the surface of the steel strip is then removed by a mechanical descaling device 10. The oxidized scale is perfectly removed by an acid pickling tank 11. Then, the steel strip is subjected to pre-processing rolling at a reduction ratio exceeding 5% with a mill 1 after the steel strip has passed through a rinsing device, a drier 12, and an outlet looper 13. The thus pre-processed steel strip is wound on a tension reel 4 and can subsequently be cold-rolled.

Figure 2:
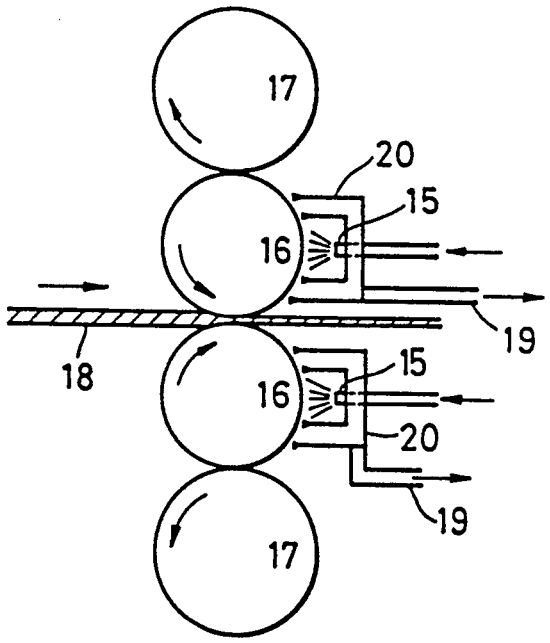
FIG. 2 is a schematic view which illustrates an embodiment of a pre-processing rolling mill according to the present invention.

FIG. 2 is a view which illustrates an embodiment of a pre-processing mill 1 according to the present invention. Liquid lubricant, supplied through a nozzle 15 on the downstream side of the roll relative to the mill 1, is adhered to a work roll 16 while cooling down the work roll 16.

The mill 1 may comprise either a vertical type mill or a cluster type mill if it has a roll arrangement consisting of two or more stages. One or a plurality of the mills may be arranged. In order to obtain satisfactory flatness, the mill may be of a type exhibiting shape control performance.

The mill 1 must have the upstream surfaces of its rolls supplied with liquid lubricant at a thickness of 1 μm or less prior to contact with the steel strip in order to conduct the pre-processing according to the present invention The liquid lubricant may be applied by using a roll coater or the like in the case where the mill has a two-stage roll arrangement. In the case where the mill has a roll arrangement consisting of four or more stages, the above-described object can be achieved with advantage in terms of extremely simple operation control by using a thin film of the lubricant which has been supplied from the outlet side of the mill 1 and introduced between the work roll and its neighboring roll, as shown in FIG. 2. According to this structure, the lubricant can be distributed widthwise between the rolls so that uniform lubricant distribution can be obtained.

The liquid lubricant is drawn by vacuum at the double-wall outer shell of a jacket 20 so that it is drawn out by a pipe 19. A large portion of the liquid lubricant adhered to the surfaces of the rolls is removed between the work roll 16 and the neighboring roll 17 during the rotation of the rolls. A portion of the liquid lubricant is uniformly distributed and introduced between the rolls 16,66. Then, the liquid lubricant delivered from the space between the rolls is divided with some flowing into the surface of the work roll 16 and some to the neighboring roll 17 so that only the thin layer of liquid lubricant adhered to the surface of each work roll 16 is introduced into the space between the stainless steel strip 18 and the work roll 16.

Although FIG. 2 illustrates a jacket nozzle spray using a jacket as an example of a liquid supply device on the outlet side of the mill, a variety of modifications can be employed such as atomizing the liquid lubricant or applying the same by using a roll coater provided on the outlet side o±the mill, as an alternative to the nozzle spray.

A structure in which air is sprayed or another structure in which a wiper is provided may be employed in order to cause the thickness of the liquid lubricant adhered to the surface of the work roll on the inlet side of the mill to be further reduced.

EXAMPLES

The apparatus and method according to the present invention were subjected to numerous tests. As an example of the annealed and pickled ferritic stainless steel SUS430 steel strip was used. As an example of the austenitic stainless steel, SUS304 steel strip was used. Preprocessing in accordance with this invention was conducted at reduction ratios shown in Tables 1 to 3, as will be discussed in detail hereinafter, by using skin-pass oil, water, cold rolling oil, and cold rolling oil emulsion respectively as the liquid lubricants. Then, cold rolling was conducted before final annealing and pickling or bright annealing. Then the samples were subjected to skin pass rolling. The SUS304 steel strips which had been subjected to final annealing and pickling were subjected to buffing under the same conditions after skin pass rolling.

Table 1 shows the results of cold rolling conducted by using a large-diameter work roll of a cold tandem mill, while Table 2 shows the results of cold rolling conducted by using a small-diameter work roll of a Sendzimir mill. Table 3 shows the results of an experiment in which the steel strip was cold-rolled by using the Sendzimir mill after cold rolling by using a cold tandem mill.

Tables 1 to 3 also show the results of visual checks of the surface luster of the above-described cold-rolled stainless steel strips. The evaluations of the visual checks were conducted in accordance with the criterion on surface luster arranged to be 5 degrees from Special A, and A to D. Furthermore, the results of the visual check of a cold-rolled stainless steel strip manufactured by a conventional manufacturing method and apparatus are simultaneously shown As clearly shown from Tables 1 to 3, the cold rolled stainless steel strips manufactured after pre-processing by the method and the apparatus according to the present invention displayed excellent surface luster in manufacturing processes such as rolling conducted by using large-diameter work rolls such as the cold tandem mill, rolling conducted by small-diameter work rolls such as in a Sendzimir mill, or their combination, in any of the cases in which the ferritic SUS430 steel strip or the austenitic SUS304 steel strip was used. Therefore, it is apparent that the method and the apparatus according to the present invention is significantly effective to improve the surface luster.

EFFECT OF THE INVENTION

As described above, cold-rolled stainless steel strip manufactured after pre-processing by the apparatus and method according to the present invention exhibits excellent surface luster in comparison to that of cold-rolled stainless steel manufactured by the conventional apparatus and the method. In particular, the steel strip manufactured by the conventional apparatus and method displays unsatisfactory surface luster in the case where rolling is conducted by a large-diameter work roll such as a cold tandem mill or the like. Since generally cold-rolled stainless steel strips are required to exhibit excellent surface luster, the rolled products manufactured by using the large-diameter work roll according to conventional methods and apparatus have been impossible to employ. However, according to the present apparatus and the method, a surface luster which had been achieved by using the Sendzimir mill can be obtained. Therefore, high quality products can be efficiently manufactured by using the tandem mill, which has been designed for mass production.

TABLE 1

| | Type of steel | Examples | Liquid Lubricant at pre-processing rolling | Reduction ratio at pre-processing rolling (%) | Thickness of oil adhered to surface of input side work roll at pre-processing rolling (μm) | Visual check on surface luster of finished steel strip* |
|---|---|---|---|---|---|---|
| In the case of cold tandem mill (large-diameter | SUS 430 | Present Invention | Skin-pass oil | 5.5 | 0.7 | B to C |
| | | | Skin-pass oil | 10.0 | 0.5 | B |
| | | | Cold rolling oil emulsion | 17.0 | 0.2 | A to B |
| | | Conventional Example | — | — | — | D |
| | SUS | Present | Skin-pass oil | 5.5 | 0.5 | B |

TABLE 1-continued

| | Type of steel | Examples | Liquid Lubricant at pre-processing rolling | Reduction ratio at pre-processing rolling (%) | Thickness of oil adhered to surface of input side work roll at pre-processing rolling (μm) | Visual check on surface luster of finished steel strip* |
|---|---|---|---|---|---|---|
| work roll used) (finish annealing and pickling were conducted) | 304 | Invention | Skin-pass oil | 10.0 | 0.3 | B |
| | | | Cold rolling oil emulsion | 17.0 | 0.1 | B |
| | | Conventional example | — | — | — | B |

*Where Special A means excellent, A means good, B means medium, C means unsatisfactory, D means no good.

TABLE 2

| | | Type | Examples | Liquid lubricant at pre-processing rolling | Reduction Ratio at pre-processing rolling (%) | Thickness of oil adhered surface of input side work roll at pre-processing rolling (μm) | Visual check on surface of finished steel strip |
|---|---|---|---|---|---|---|---|
| In the case of Sendzimir mill (small-diameter work roll used) | Finish annealing and pickling were conducted | SUS 430 | Present invention | Cold rolling oil | 6.0 | 0.6 | A |
| | | | | Cold rolling oil | 8.0 | 0.5 | A |
| | | | | Cold rolling oil | 12.5 | 0.3 | A |
| | | | Conventional example | — | — | — | B |
| | | SUS 304 | Present Invention | Cold rolling oil | 6.0 | 0.5 | A |
| | | | | Cold rolling oil | 8.0 | 0.4 | A |
| | | | | Cold rolling oil | 12.5 | 0.2 | A |
| | | | Conventional example | — | — | — | B |
| | Finish bright annealing was conducted | SUS 430 | Present Invention | Skin-pass oil | 5.5 | 0.7 | A |
| | | | | Skin-pass oil | 9.0 | 0.4 | A |
| | | | | Skin-pass oil | 13.5 | 0.3 | Special A |
| | | | Conventional example | — | — | — | B |
| | | SUS 304 | Present Invention | Skin-pass oil | 5.5 | 0.5 | A |
| | | | | Skin-pass oil | 9.0 | 0.3 | A |
| | | | | Skin-pass oil | 13.5 | 0.2 | Special A |
| | | | Conventional example | — | — | — | B |

TABLE 3

| | | Type | Examples | Liquid lubricant at pre-processing rolling | Reduction Ratio at pre-processing rolling (%) | Thickness of oil adhered surface of input side work roll at pre-processing rolling (μm) | Visual check on surface of finished steel strip |
|---|---|---|---|---|---|---|---|
| In the case where rolling is conducted with Sendizimir roll after tandem mill rolling | Finish annealing and pickling were conducted | SUS 430 | Present Invention | Skin-pass oil | 5.5 | 0.7 | B |
| | | | | Skin-pass oil | 10.0 | 0.5 | A to B |
| | | | | Skin-pass oil | 13.5 | 0.3 | A |
| | | | Conventional example | — | — | — | B |
| | | SUS 304 | Present Invention | Skin-pass oil | 5.5 | 0.5 | B |
| | | | | Skin-pass oil | 10.0 | 0.3 | A to B |
| | | | | Skin-pass oil | 13.5 | 0.2 | A |
| | | | Conventional example | — | — | — | B |
| | Finish Bright annealing was conducted | SUS 430 | Present invention | Water | 6.0 | 0.6 | A to B |
| | | | | Skin-pass oil | 10.5 | 0.4 | A |
| | | | | Cold rolling oil | 15.0 | 0.2 | Special A |
| | | | Conventional Example | — | — | — | B |
| | | SUS 304 | Present Invention | Water | 6.0 | 0.5 | A to B |
| | | | | Skin-pass oil | 10.5 | 0.3 | A |
| | | | | Cold rolling oil | 15.0 | 0.1 | Special A |
| | | | Conventional example | — | — | — | B |

What is claimed is:

1. A method of pre-processing a hot rolled stainless steel strip intended to be cold-processed, comprising the steps of:

annealing and pickling the stainless steel strip after completing hot rolling;

conducting the strip between the surfaces of strip processing rolls;

applying to the surfaces of said rolls a liquid lubricant having a viscosity of 1–15 cst and having a thickness of 1 μm or less before said rolls come into contact with said stainless steel strip; and cold rolling said stainless steel strip in the presence of said lubricant at a reduction ration of 5–20%.

2. A method according to claim 1, wherein the thickness of said liquid lubricant applied to the surfaces of said rolls is 0.5 μm or less.

3. A method according to claim 1, wherein said liquid lubricant is selected from the group consisting of water, skin-pass oil, rolling oil, and rolling oil emulsion.

4. A method according to claim 1, including the step of cold tandem rolling the strip subsequent to said cold rolling step.

* * * * *